US008922104B1

(12) United States Patent
Inoue et al.

(10) Patent No.: US 8,922,104 B1
(45) Date of Patent: Dec. 30, 2014

(54) SPARK PLUG HAVING AN EMBEDDED TIP THAT IS PREVENTED FROM DETACHMENT DUE TO THERMAL STRESS

(71) Applicant: NGK Spark Plug Co., Ltd., Nagoya (JP)

(72) Inventors: Masahiro Inoue, Gifu (JP); Satoshi Nagasawa, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 14/330,420

(22) Filed: Jul. 14, 2014

(30) Foreign Application Priority Data

Jul. 16, 2013 (JP) ..... 2013-147213

(51) Int. Cl.
*H01T 13/39* (2006.01)
*H01T 13/32* (2006.01)
*H01T 13/20* (2006.01)
*H01T 21/02* (2006.01)

(52) U.S. Cl.
CPC ..... *H01T 13/20* (2013.01); *H01T 21/02* (2013.01)
USPC ..... 313/141; 313/142; 313/143

(58) Field of Classification Search
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 6,215,235 | B1 * | 4/2001 | Osamura | 313/141 |
| 6,337,533 | B1 * | 1/2002 | Hanashi et al. | 313/141 |
| 6,642,638 | B2 * | 11/2003 | Ishiguro | 313/141 |
| 8,188,641 | B2 * | 5/2012 | Kameda et al. | 313/142 |
| 2002/0017846 | A1 * | 2/2002 | Hori | 313/141 |
| 2005/0176332 | A1 * | 8/2005 | Juestel et al. | 445/7 |
| 2007/0103046 | A1 * | 5/2007 | Tinwell | 313/143 |
| 2012/0074828 | A1 | 3/2012 | Inoue et al. | |
| 2013/0328476 | A1 * | 12/2013 | Ban et al. | 313/141 |
| 2014/0062284 | A1 * | 3/2014 | Yoshizaki et al. | 313/141 |

FOREIGN PATENT DOCUMENTS

JP 2012-94492 A 5/2012

* cited by examiner

*Primary Examiner* — Tracie Y Green
(74) *Attorney, Agent, or Firm* — Leason Ellis LLP.

(57) ABSTRACT

A spark plug includes a center electrode, a ground electrode, and a ground-electrode-side tip joined to the ground electrode such that at least a portion of the tip along its thickness direction is embedded in the ground electrode. The ground-electrode-side tip is joined to the ground electrode through a fusion zone formed between the ground electrode and a proximal side of the tip. On a section containing a center axis of the ground electrode and in parallel with the thickness direction of the ground-electrode-side tip, E/F≥1.1 is satisfied, where E (mm) is the longest distance along the thickness direction from an inner side of the ground electrode to a boundary between the fusion zone and the ground electrode, and F (mm) is the largest amount of embedment of the tip in the inner side surface along the thickness direction.

14 Claims, 7 Drawing Sheets

SPARK PLUG HAVING AN EMBEDDED TIP THAT IS PREVENTED FROM DETACHMENT DUE TO THERMAL STRESS

This application claims the benefit of Japanese Patent Applications No. 2013-147213 filed on Jul. 16, 2013, which is incorporated by reference in its entirety herein.

FIELD OF THE INVENTION

The present invention relates to a spark plug for use in an internal combustion engine or the like and to a method of manufacturing the same.

BACKGROUND OF THE INVENTION

A spark plug for use in an internal combustion engine or the like includes, for example, an insulator having an axially extending axial hole; a center electrode inserted into a forward end portion of the axial hole; a tubular metallic shell provided around the insulator; and a rodlike ground electrode fixed to a forward end portion of the metallic shell. Also, a gap is formed between a distal end portion of the ground electrode and a forward end portion of the center electrode for generating spark discharge through application of voltage across the gap.

According to a known technique for improving resistance to spark-discharge-induced erosion, a tip formed of a metal having excellent durability, such as a noble metal alloy, is joined to a surface of the ground electrode which faces the forward end portion of the center electrode, thereby forming the gap between the tip and the forward end portion of the center electrode. Furthermore, in order to improve joining strength, at least a portion of the tip is embedded in the ground electrode along the thickness direction of the tip (refer to, for example, Patent Japanese Patent Application Laid-Open (kokai) No. 2012-94492).

Problem to be Solved by the Invention

However, in the case where the tip is embedded in the ground electrode, while joining strength is improved, the difference in thermal expansion (thermal stress) in the direction of thickness of the tip between the tip and the ground electrode becomes large. Thus, oxide scale is apt to be formed between the tip and the ground electrode, potentially resulting in detachment (separation) of the tip from the ground electrode.

In recent years, in order to improve fuel economy or for other purposes, high compression has been implemented in an internal combustion engine, etc. In such an internal combustion engine, etc., the tip is likely to have a very high temperature. Accordingly, the thermal stress is apt to further increase; therefore, detachment of the tip is of greater concern.

The present invention has been conceived in view of the above circumstances, and an object of the invention is to reliably prevent detachment of the tip from the ground electrode in a spark plug in which at least a portion of the tip is embedded in the ground electrode.

SUMMARY OF THE INVENTION

Means for Solving the Problem

Configurations suitable for achieving the above object will next be described in itemized form. When needed, actions and effects peculiar to the configurations will be described additionally.

Configuration 1. A spark plug of the present configuration comprises

- a tubular insulator having an axial hole extending therethrough in an axial direction;
- a center electrode inserted into a forward end portion of the axial hole;
- a tubular metallic shell provided around the insulator;
- a rodlike ground electrode whose proximal end portion is fixed to a forward end portion of the metallic shell; and
- a tip that is joined to the ground electrode such that at least a portion of the tip along a thickness direction of the tip is embedded in an inner side surface of the ground electrode located toward the center electrode, wherein
- a gap is formed between the tip and a forward end portion of the center electrode.

In the spark plug, the tip is joined to the ground electrode through a fusion zone which is provided between the ground electrode and a proximal side of the tip facing the proximal end portion of the ground electrode, the tip and the ground electrode being fused at the fusion zone, and

- in a section which contains a center axis of the ground electrode and is in parallel with the thickness direction of the tip, a relational expression $E/F \geq 1.1$ is satisfied, where E (mm) is a longest distance along the thickness direction from the inner side surface to a boundary between the fusion zone and the ground electrode, and F (mm) is a largest amount of embedment of the tip in the inner side surface along the thickness direction.

The greater the largest amount of embedment F of the tip, the greater the thermal expansion difference (thermal stress) between the tip and the ground electrode. The greater the depth E of the fusion zone, the higher the effect of the fusion zone's absorbing the thermal expansion difference (thermal stress). In this connection, according to configuration 1, the relational expression $E/F \geq 1.1$ is satisfied; thus, the fusion zone can sufficiently absorb the thermal expansion difference (thermal stress) between the tip and the ground electrode. In other words, the difference in thermal expansion between the tip and the ground electrode can be relieved. Therefore, the formation of oxide scale at the interface between the tip and the ground electrode can be effectively restrained, whereby the detachment of the tip from the ground electrode can be reliably prevented.

Configuration 2. A spark plug of the present configuration is characterized in that, in configuration 1, a relational expression $E/F \geq 1.5$ is satisfied.

According to configuration 2, the fusion zone can absorb the thermal expansion difference (thermal stress) to a greater extent, whereby the formation of oxide scale can be restrained further effectively. As a result, the detachment of the tip can be prevented further reliably.

Configuration 3. A spark plug of the present configuration is characterized in that, in configuration 1 or 2, the gap is formed between the forward end portion of the center electrode and a first side of the tip facing the center electrode and adjacent to a distal end surface of the tip located toward a distal end portion of the ground electrode;

- the distal end surface of the tip is disposed at the same position along the center axis as that of a distal end of the ground electrode or protrudes from the distal end of the ground electrode;
- the fusion zone is formed only on a side of the proximal side of the tip with respect to a center point of the tip along the center axis; and
- in the section, a relational expression $A/B \leq 0.6$ is satisfied, where A (mm) is a longest distance along the center axis from the proximal side of the tip to a boundary between the fusion zone and a second side of the tip located opposite the first side, and B (mm) is a longest distance along the center axis from the distal end surface of the ground electrode to the proximal side of the tip.

According to configuration 3, the distal end surface (a surface located toward the distal end of the ground electrode) of the tip is disposed at the same position as that of the distal end of the ground electrode or protrudes from the distal end of the ground electrode. Therefore, the ground electrode's hindrance to growth of a flame nucleus can be effectively restrained, whereby ignition performance can be improved.

According to configuration 3, the fusion zone is formed only on the side toward the proximal side of the tip (toward the proximal end portion of the ground electrode) with respect to the center point of the tip, and the relational expression $A/B \leq 0.6$ is satisfied. That is, the range of formation of the fusion zone along the center axis of the ground electrode is not excessively large such that the fusion zone does not intervene over a relatively wide range between the ground electrode and a portion of the tip located toward the distal end of the tip (examples of such a condition include a condition in which the tip is not welded to the ground electrode, and a condition in which the tip is solid-phase-joined to the ground electrode; i.e., a condition in which the strength of joining the tip to the ground electrode is relatively low). Thus, at the time of operation of an internal combustion engine or the like, the thermal expansion difference (thermal stress) between the ground electrode and the second side of the tip can be increased to a certain extent, whereby the tip can be deformed (warped) in such a manner as to approach the forward end portion of the center electrode. Therefore, while the center electrode and the tip are eroded as a result of spark discharge, etc., the tip approaches the center electrode, whereby an increase in the gap stemming from erosion of the center electrode and the tip can be effectively restrained. As a result, an increase in voltage required for generation of spark discharge (discharge voltage) can be restrained, whereby ignition performance and durability can be improved.

As in the case of configuration 3, in the case where the distal end surface of the tip is disposed at the same position as that of the distal end surface of the ground electrode or protrudes from the distal end surface of the ground electrode, the tip is apt to have a higher temperature. Thus, detachment of the tip is of greater concern; however, the employment of configurations 1 and 2 can eliminate such concern. In other words, configurations 1 and 2 are particularly effective for a spark plug configured such that the distal end surface of the tip is disposed at the same position as that of the distal end surface of the ground electrode or protrudes from the distal end surface of the ground electrode.

Configuration 4. A spark plug of the present configuration is characterized in that, in configuration 3, a relational expression $C/(B-A) \leq 0.95$ is satisfied, where C (mm) is a largest thickness of the tip.

The greater the amount of B−A, the greater the amount of deformation of the tip (the amount of approach to a forward end portion of the center electrode), whereas the larger the largest thickness C of the tip, the smaller the amount of deformation of the tip. In view of this, according to configuration 4, the relational expression $C/(B-A) \leq 0.95$ is satisfied; thus, at the time of operation of an internal combustion engine or the like, the amount of deformation of the tip becomes substantially equivalent to the amount of increase in the gap stemming from erosion (the amount of increase in the case where the tip is not deformed). Therefore, the tip can be brought closer to the center electrode according to the amount of erosion of the center electrode and the tip, whereby the gap can be maintained at a substantially fixed amount over a long period of time. As a result, good ignition performance and durability can be maintained over a long period of time.

Configuration 5. A spark plug of the present configuration is characterized in that, in any one of configurations 1 to 4, a relational expression $D/C \leq 0.7$ is satisfied, where C (mm) is a largest thickness of the tip, and D (mm) is an amount of protrusion of the tip from the inner side surface along the thickness direction.

According to configuration 5, the relational expression $D/C \leq 0.7$ is satisfied, whereby the amount of embedment of the tip in the ground electrode is sufficiently large. Therefore, the strength of joining the tip to the ground electrode can be remarkably improved, whereby separation resistance can be further improved. Also, since conduction of heat of the tip to the ground electrode is facilitated, erosion of the tip can be effectively restrained, whereby durability can be further improved.

Configuration 6. A method of manufacturing a spark plug of the present configuration is adapted to manufacture a spark plug according to any one of configurations 1 to 5 and comprises a step of joining the tip to the ground electrode through application electricity to the tip in a condition in which the proximal side of the tip is in a point or line contact with the ground electrode.

The term "point contact" means not only a case where the ground electrode and the tip are in a point contact with each other in a strict sense (that is, the contact area between the ground electrode and the tip is substantially zero), but also a case where the contact area between the ground electrode and the tip exists to a certain extent. Also, the term "line contact" means not only a case where the ground electrode and the tip are in a line contact with each other in a strict sense (that is, the contact area between the ground electrode and the tip is substantially zero), but also a case where the contact area between the ground electrode and the tip exists to a certain extent.

According to configuration 5, at the time of application of electricity, heat can be generated concentrically at a contact portion between the ground electrode and a proximal side of the tip. Therefore, the fusion zone can be reliably formed between the ground electrode and the proximal side of the tip, whereby the spark plugs according to configurations 1 to 5 can be readily yielded.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Modes for Carrying Out the Invention

Figure 1:
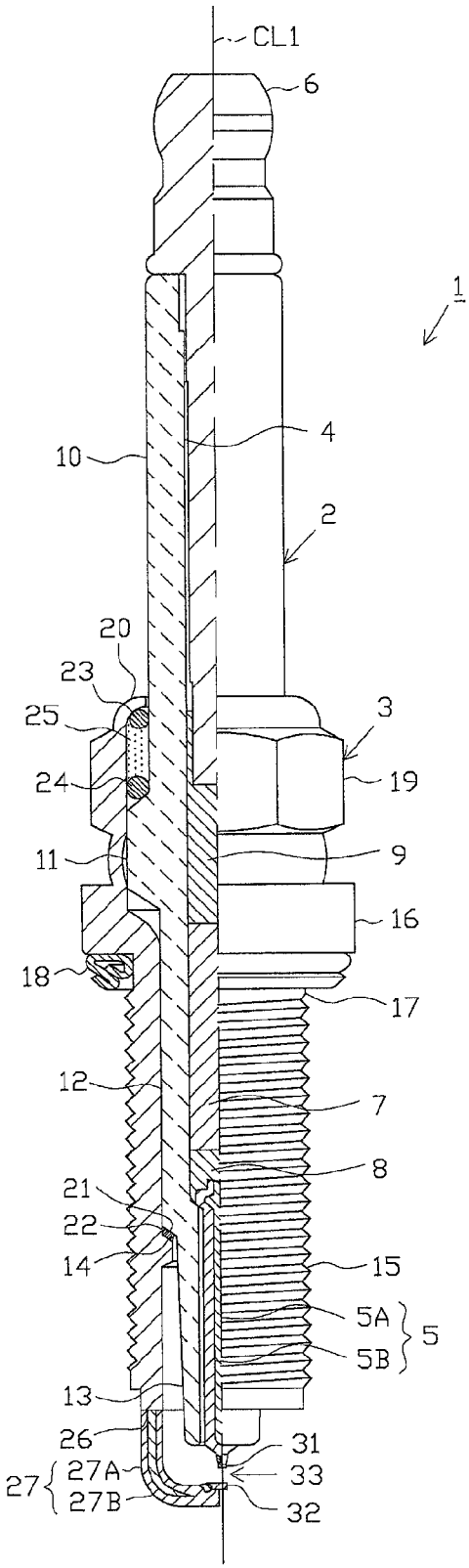
FIG. 1 is a partially cutaway front view showing the configuration of a spark plug.

An embodiment of the present invention will next be described with reference to the drawings. FIG. 1 is a partially cutaway front view showing a spark plug 1. In the following description with reference to FIG. 1, the direction of an axial line CL1 of the spark plug 1 is referred to as the vertical direction; the lower side is referred to as the forward side of the spark plug 1; and the upper side as the rear side.

The spark plug 1 includes a tubular insulator 2 and a tubular metallic shell 3 which holds the insulator 2 therein.

The insulator 2 is formed from alumina or the like by firing, as well known in the art. The insulator 2, as viewed externally, includes a rear trunk portion 10 formed on the rear side; a large-diameter portion 11 located forward of the rear trunk portion 10 and protruding radially outward; an intermediate trunk portion 12 located forward of the large-diameter portion 11 and being smaller in diameter than the large-diameter portion 11; and a leg portion 13 located forward of the intermediate trunk portion 12 and being smaller in diameter than the intermediate trunk portion 12. Additionally, the large-diameter portion 11, the intermediate trunk portion 12, and most of the leg portion 13 are accommodated in the metallic shell 3. A tapered, stepped portion 14 is formed at a connection portion between the leg portion 13 and the intermediate trunk portion 12. The insulator 2 is seated on the metallic shell 3 at the stepped portion 14.

Furthermore, the insulator 2 has an axial hole 4 extending therethrough along the axial line CL1, and a center electrode 5 is inserted into a forward end portion of the axial hole 4. The center electrode 5 includes an inner layer 5A formed of a metal having excellent thermal conductivity (e.g., copper or a copper alloy) and an outer layer 5B formed of an alloy which contains nickel (Ni) as a main component. Furthermore, the center electrode 5 has a circular columnar center-electrode-side tip 31 provided at its forward end portion and formed of a metal having excellent erosion resistance (e.g., a metal which contains one or more of Pt, Ir, Pd, Rh, Ru, Re, etc.). Also, the center electrode 5 has a rodlike (circular columnar) shape as a whole and protrudes from the forward end of the insulator 2.

Additionally, an electrode terminal 6 is fixedly inserted into a rear end portion of the axial hole 4 and protrudes from the rear end of the insulator 2.

Furthermore, a circular columnar resistor 7 is disposed within the axial hole 4 between the center electrode 5 and the electrode terminal 6. Opposite end portions of the resistor 7 are electrically connected to the center electrode 5 and the electrode terminal 6 via electrically conductive glass seal layers 8 and 9, respectively.

Additionally, the metallic shell 3 is formed into a tubular shape from a low-carbon steel or a like metal and has a threaded portion (externally threaded portion) 15 on its outer circumferential surface for mounting the spark plug 1 into a mounting hole formed in a combustion apparatus (e.g., an internal combustion engine or a fuel cell reformer). The metallic shell 3 has a seat portion 16 formed on its outer circumferential surface and located rearward of the threaded portion 15. A ring-like gasket 18 is fitted to a screw neck 17 located at the rear end of the threaded portion 15. Furthermore, the metallic shell 3 has a tool engagement portion 19 provided near its rear end, having a hexagonal cross section, and allowing a tool such as a wrench to be engaged therewith when the metallic shell 3 is to be attached to the combustion apparatus. Also, the metallic shell 3 has a crimped portion 20 provided at its rear end portion and adapted to hold the insulator 2.

Also, the metallic shell 3 has a tapered, stepped portion 21 provided on its inner circumferential surface and adapted to allow the insulator 2 to be seated thereon. The insulator 2 is inserted forward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimped portion 20 is formed, whereby the insulator 2 is fixed to the metallic shell 3. An annular sheet packing 22 intervenes between the stepped portions 14 and 21. This retains airtightness of a combustion chamber and prevents outward leakage of fuel gas which enters a clearance between the leg portion 13 of the insulator 2 and the inner circumferential surface of the metallic shell 3, the clearance being exposed to the combustion chamber.

Furthermore, in order to ensure airtightness which is established by crimping, annular ring members 23 and 24 intervene between the metallic shell 3 and the insulator 2 in a region near the rear end of the metallic shell 3, and a space between the ring members 23 and 24 is filled with powder of talc 25. That is, the metallic shell 3 holds the insulator 2 through the sheet packing 22, the ring members 23 and 24, and the talc 25.

Figure 2:
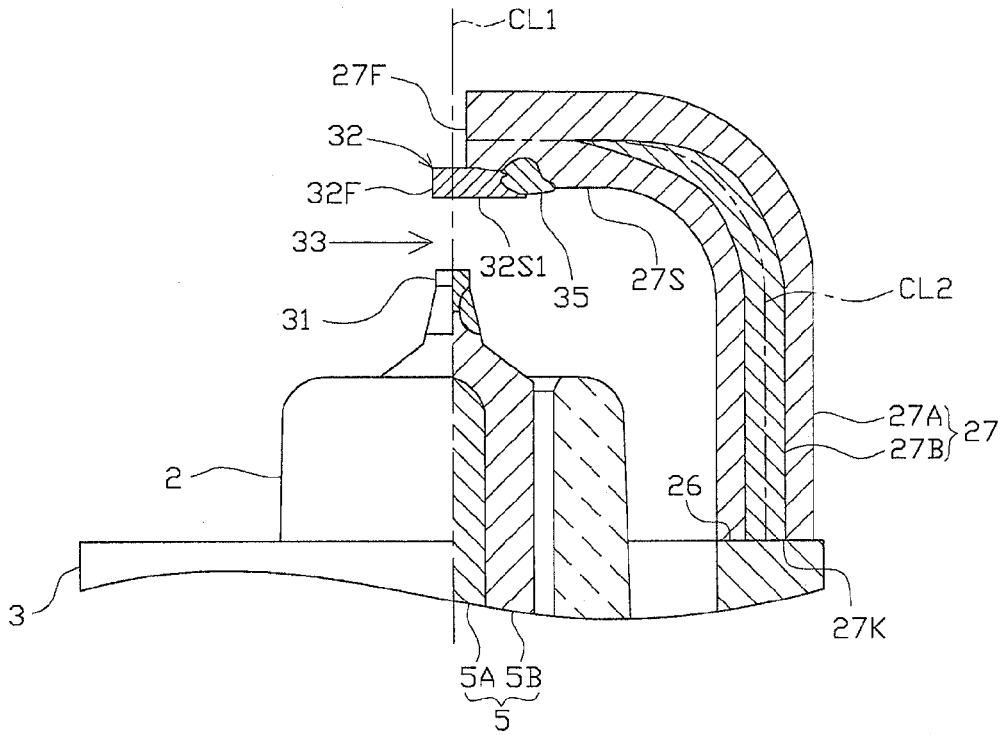
FIG. 2 is a partially cutaway enlarged front view showing the configuration of a forward end portion of the spark plug.

Also, as shown in FIG. 2, a proximal end portion 27K of a rodlike ground electrode 27 is joined to a forward end portion 26 of the metallic shell 3. The ground electrode 27 has a rectangular cross section and is bent at its substantially intermediate portion. The ground electrode 27 includes an outer layer 27A formed of an Ni alloy [e.g., INCONEL 600 or INCONEL 601 (registered trademark)] and an inner layer 27B provided in the outer layer 27A and formed of a metal superior to the outer layer 27A in thermal conductivity (e.g., copper or a copper alloy). The ground electrode 27 may be formed of a single kind of metal (e.g., an Ni alloy) without provision of the inner layer 27B.

Additionally, the ground electrode 27 has, at its distal end portion, a rectangular-parallelepiped ground-electrode-side tip 32 (corresponding to the "tip" in the present invention) joined thereto by resistance welding and formed of a metal having excellent erosion resistance (e.g., a metal which contains one or more of Pt, Ir, Pd, Rh, Ru, Re, etc.). In the present embodiment, the ground-electrode-side tip 32 is joined to the ground electrode 27 at a central portion of the ground electrode 27 along the width direction of the ground electrode 27. Also, the ground-electrode-side tip 32 is joined to the ground electrode 27 such that a portion of the tip 32 protrudes from a forward end surface 27F of the ground electrode 27 and from an inner side surface 27S of the ground electrode 27 located toward the center electrode 5 and such that at least a portion of the tip 32 along the thickness direction of the tip 32 is embedded in the ground electrode 27.

Figure 3:
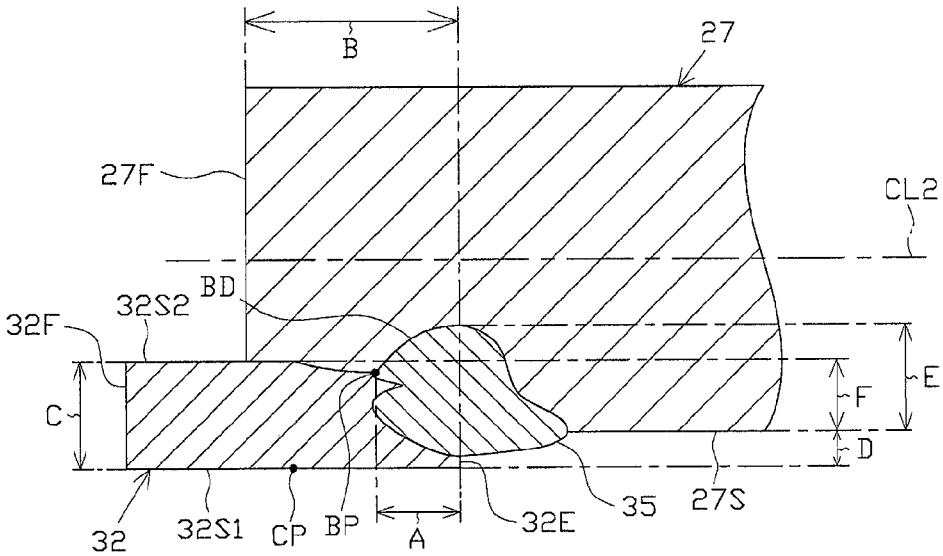
FIG. 3 is an enlarged sectional view showing a fusion zone and its periphery.

Furthermore, in the present embodiment, as shown in FIG. 3, the ground-electrode-side tip 32 is joined to the ground electrode 27 through a fusion zone 35 in which the tip 32 and the ground electrode 27 fuse together. The fusion zone 35 is provided between the ground electrode 27 and a proximal end portion 32E of the ground-electrode-side tip 32 located toward the proximal end portion 27K of the ground electrode 27. Particularly, in the present embodiment, the fusion zone 35 is formed only on the side toward the proximal side of the tip 32E with respect to a center point CP of the ground-electrode-side tip 32 along the center axis CL2 of the ground electrode 27.

Additionally, as shown in FIGS. 2 and 3, a spark discharge gap 33, which corresponds to the gap of the present invention, is formed between a forward end portion of the center electrode 5 (center-electrode-side tip 31) and a first side 3251 of the ground-electrode-side tip 32 located toward the center electrode 5 (center-electrode-side tip 31) and adjacent to a distal end surface 32F of the ground-electrode-side tip 32 located toward a distal end portion of the ground electrode 27. Through application of voltage across the spark discharge gap 33, spark discharge is performed substantially along the axial line CL1.

Also, according to the present embodiment, in a section which contains the center axis CL2 of the ground electrode 27 and is taken in parallel with the thickness direction of the ground-electrode-side tip 32, the relational expression $E/F \geq 1.1$ (more preferably, $E/F \geq 1.5$) is satisfied, where, E (mm) is the greatest distance along the thickness direction from the inner side surface 27S of the ground electrode 27 to the boundary BD between the fusion zone 35 and the ground electrode 27, and F (mm) is the largest amount of embedment of the tip 32 in the inner side surface 27S along the thickness direction.

In order to prevent the fusion zone 35 from becoming excessively large in joining the ground-electrode-side tip 32 by resistance welding, preferably, the relational expression $E/F \leq 2.5$ is satisfied. In order to excessively increase the size of the fusion zone 35, an excessively large current must be applied to the ground electrode 27 and the ground-electrode-side tip 32. Application of such an excessively large current forms a substance called dendrite in the base material of the ground electrode 27 as a result of melting and solidification. The existence of dendrite may possibly deteriorate oxidation resistance, etc.

Furthermore, in the section, the relational expression $A/B \leq 0.6$ is satisfied, where A (mm) is a greatest distance along the center axis CL2 from the proximal end portion 32E of the ground-electrode-side tip 32 to the boundary BP between the fusion zone 35, the ground electrode 27, and a second side 32S2 of the tip 32 located opposite the first side 32S1, and B (mm) is a greatest distance along the center axis CL2 from the distal end surface 27F of the ground electrode 27 to the proximal end portion 32E of the ground-electrode-side tip 32. That is, the range of formation of the fusion zone 35 along the center axis CL2 is not excessively large such that a portion of the ground-electrode-side tip 32 located toward the distal end of the tip 32 is not welded to the ground electrode 27 over a relatively wide range. In view of ensuring good joining strength, preferably, A/B is equal to or greater than a predetermined value (e.g., 0.15).

Additionally, through satisfaction of the relational expression $A/B \leq 0.6$, the ground-electrode-side tip 32 is deformed (warped) in such a manner that a distal end portion of the tip 32 approaches a forward end portion of the center electrode 5, by the effect of thermal stress which is generated between the ground electrode 27 and the ground-electrode-side tip 32 as a result of operation (heat cycle) of an internal combustion engine or the like. The greater the amount of B−A, the greater the amount of deformation of the ground-electrode-side tip 32 (the amount of approach to a forward end portion of the center electrode 5), whereas the larger the largest thickness of the ground-electrode-side tip 32, the smaller the amount of deformation of the ground-electrode-side tip 32. In view of this, the present embodiment is configured to satisfy the relational expression $C/(B-A) \leq 0.95$, where C (mm) is a largest thickness of the ground-electrode-side tip 32; thus, at the time of operation of an internal combustion engine or the like, the amount of deformation of the ground-electrode-side tip 32 (the amount of approach to a forward end portion of the center electrode 5) becomes substantially equivalent to the amount of increase in the spark discharge gap 33 (the amount of increase in the case where the ground-electrode-side tip 32 is not deformed).

Additionally, the present embodiment is configured such that the relational expression $D/C \leq 0.7$ is satisfied, where D (mm) is an amount of protrusion of the ground-electrode-side tip 32 from the inner side surface 27S along the thickness direction of the tip 32. That is, the present embodiment is configured such that the ground-electrode-side tip 32 is embedded in the ground electrode 27 by 30% or more of the thickness of the tip 32.

Next will be described a method of manufacturing the thus-configured spark plug 1.

First, the metallic shell 3 is formed beforehand. Specifically, a circular columnar metal material (e.g., an iron-based material or a stainless steel material) is subjected to cold forging, etc., so as to form a general shape and a through hole. Subsequently, machining is conducted so as to adjust the outline, thereby yielding a metallic-shell intermediate.

Separately from preparation of the metallic shell intermediate, the straight-rodlike ground electrode 27 is manufactured from an Ni alloy or a like metal. The manufactured ground electrode 27 has an inclined surface 27N located at a distal end portion of the inner side surface 27S and inclined toward the center axis CL2 while extending toward the distal end surface 27F (see FIG. 4).

Then, the ground electrode 27 is resistance-welded to the forward end surface of the metallic-shell intermediate. The resistance welding is accompanied by formation of so-called "sags." After the "sags" are removed, the threaded portion 15 is formed in a predetermined region of the metallic-shell intermediate by rolling. Thus, the metallic shell 3 to which the ground electrode 27 is welded is yielded. Also, the metallic shell 3 to which the ground electrode 27 is welded is subjected to galvanization or nickel plating. In order to enhance corrosion resistance, the plated surface may be further subjected to chromate treatment.

Separately from preparation of the metallic shell 3, the insulator 2 is formed. Specifically, a forming material granular-substance is prepared by use of material powder which contains alumina in a predominant amount, a binder, etc. By use of the prepared forming material granular-substance, a tubular green compact is formed by rubber press forming. The thus-formed green compact is subjected to grinding for shaping. The shaped green compact is fired in a kiln, thereby yielding the insulator 2.

Also, separately from preparation of the metallic shell 3 and the insulator 2, the center electrode 5 is formed. Specifically, an Ni alloy in which a copper alloy or a like metal is disposed in a central region for improving heat radiation performance is subjected to forging, thereby yielding the center electrode 5. Furthermore, the center-electrode-side tip 31 is joined to a forward end portion of the center electrode 5 by laser welding or the like.

Next, the insulator 2 and the center electrode 5 formed as mentioned above, the resistor 7, and the electrode terminal 6 are fixed in a sealed condition by means of the glass seal layers 8 and 9. The glass seal layers 8 and 9 are generally formed of a mixture of borosilicate glass and metal powder; the mixture is charged into the axial hole 4 of the insulator 2 in such a manner that the resistor 7 is sandwiched between the charged portions of the mixture; subsequently, while being pressed from the rear side by the electrode terminal 6, the charged mixture is hardened through application of heat in a kiln. At this time, a glaze layer may be simultaneously formed on the surface of the rear trunk portion 10 of the insulator 2; alternatively, the glaze layer may be formed beforehand.

Subsequently, the thus-formed insulator 2 having the center electrode 5 and the electrode terminal 6, and the metallic shell 3 having the ground electrode 27 are fixed together. More specifically, in a condition in which the insulator 2 is inserted through the metallic shell 3, a relatively thin-walled rear-end opening portion of the metallic shell 3 is crimped radially inward; i.e., the crimped portion 20 is formed, thereby fixing the insulator 2 and the metallic shell 3 together.

Figure 4A:
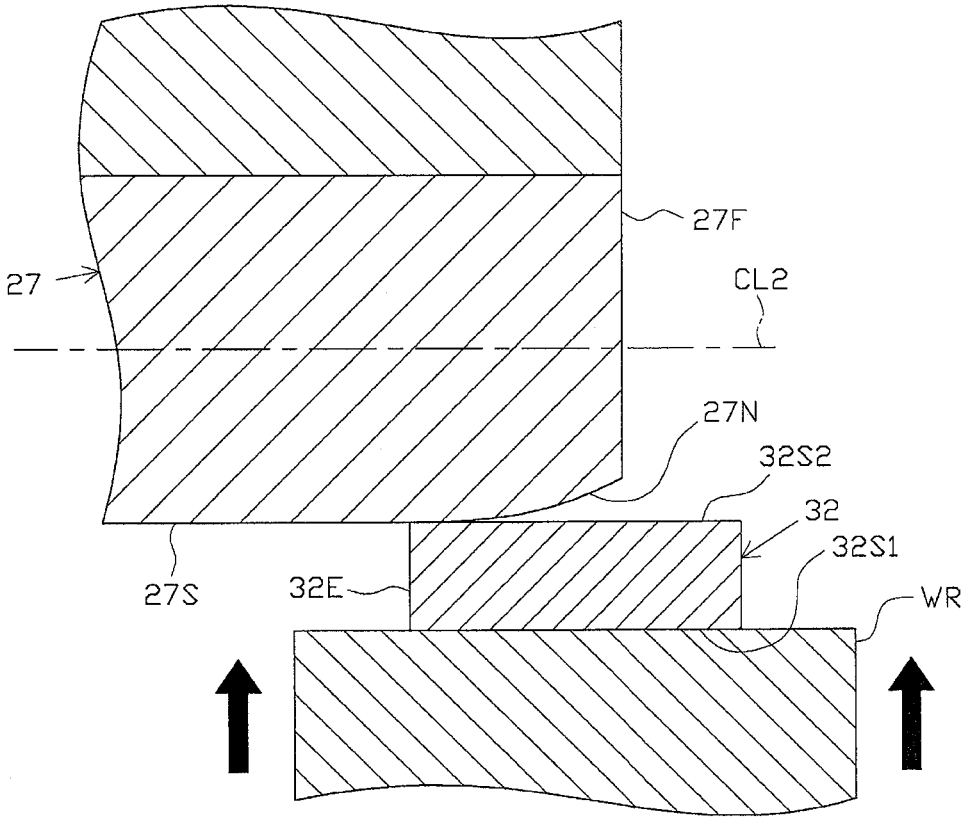
FIG. 4A is an enlarged sectional view showing a step of joining a ground-electrode-side tip to a ground electrode.
Figure 4B:
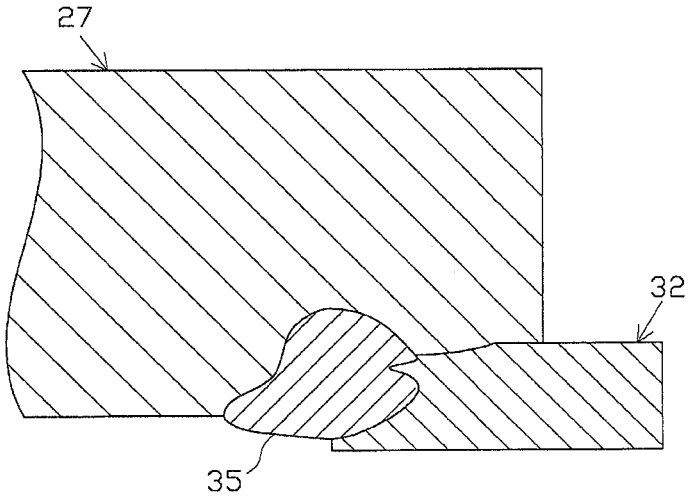
FIG. 4B is an enlarged sectional view showing a condition in which the ground-electrode-side tip and the ground electrode are joined together.

Next, the ground-electrode-side tip 32 is joined to a distal end portion of the ground electrode 27. Specifically, first, galvanization or like plating is removed from the distal end portion of the ground electrode 27. Then, as shown in FIG. 4, the ground-electrode-side tip 32 is brought into contact with the inner side surface 27S of the ground electrode 27 such that the inner side surface 27S (excluding the inclined surface 27N) of the ground electrode 27 and a surface (second side 3252) of the ground-electrode-side tip 32 to be joined to the ground electrode 27 are in parallel with each other. At this time, since the ground electrode 27 has the inclined surface 27N, the proximal end portion 32E of the ground-electrode-side tip 32 is in a point or line contact (in the present embodiment, a line contact) with the ground electrode 27. Next, while a predetermined welding rod WR presses the ground-electrode-side tip 32 toward the ground electrode 27 with a predetermined pressure, predetermined electric current is applied from the welding rod WR to the ground-electrode-side tip 32. As a result, a particularly high temperature is generated at a contact portion between the ground electrode 27 and the proximal end portion 32E of the ground-electrode-side tip 32, which are in a point or line contact with each other, whereby, as shown in FIG. 4B, the fusion zone 35 in which the ground electrode 27 and the ground-electrode-side tip 32 fuse together is formed between the proximal end portion 32E of the ground-electrode-side tip 32 and the ground electrode 27. Also, since the ground-electrode-side tip 32 is pressed, a portion of the tip 32 along the thickness direction of the tip 32 is embedded in the ground electrode 27. Through adjustment of load for pressing the ground-electrode-side tip 32, and electric current to be applied, the size of the fusion zone 35 can be adjusted, and, in turn, the greatest distance E, the largest amount of embedment F, and the greatest distances A and B can be changed.

After the ground-electrode-side tip 32 is joined, the ground electrode 27 is bent toward the center electrode 5, and the spark discharge gap 33 between the ground-electrode-side tip 32 and the center electrode 5 (center-electrode-side tip 31) is adjusted in size, thereby yielding the spark plug 1 described above.

As described in detail above, according to the present embodiment, the relational expression $E/F \geq 1.1$ is satisfied; thus, the fusion zone 35 can sufficiently absorb the thermal expansion difference (thermal stress) between the ground-electrode-side tip 32 and the ground electrode 27. Therefore, the formation of oxide scale at the interface between the ground-electrode-side tip 32 and the ground electrode 27 can be effectively restrained, whereby the detachment of the ground-electrode-side tip 32 from the ground electrode 27 can be reliably prevented.

Also, in the case of satisfaction of the relational expression $E/F \geq 1.5$, the fusion zone 35 can absorb the thermal expansion difference (thermal stress) to a greater extent, whereby the detachment of the ground-electrode-side tip 32 can be prevented further reliably.

Additionally, the distal end surface 32F of the ground-electrode-side tip 32 is disposed at the same position as that of the distal end surface 27F of the ground electrode 27 or protrudes from the distal end surface 27F of the ground electrode 27. Therefore, the ground electrode 27's hindrance to growth of a flame nucleus can be effectively restrained, whereby ignition performance can be improved.

Also, according to the present embodiment, the fusion zone 35 is formed only on the side toward the proximal end portion of the ground-electrode-side tip 32 (toward the proximal end portion 27K of the ground electrode 27) with respect to the center point CP of the tip 32, and the relational expression $A/B \leq 0.6$ is satisfied. Therefore, at the time of operation of an internal combustion engine or the like, the thermal expansion difference (thermal stress) between the ground electrode 27 and the second side 32S2 of the ground-electrode-side tip 32 can be increased to a certain extent, whereby the tip 32 can be deformed (warped) in such a manner as to approach a forward end portion of the center electrode 5 (center-electrode-side tip 31). Thus, while the center electrode 5 and the ground-electrode-side tip 32 are eroded as a result of spark discharge, etc., the tip 32 approaches the center electrode 5, whereby an increase in the spark discharge gap 33 stemming from erosion of the center electrode 5 and the tip 32 can be effectively restrained. As a result, an increase in voltage required for generation of spark discharge (discharge voltage) can be restrained, whereby ignition performance and durability can be improved.

Furthermore, since the relational expression $C/(B-A) \leq 0.95$ is satisfied, the ground-electrode-side tip 32 can be brought closer to the center electrode 5 according to the amount of erosion of the center electrode 5 and the tip 32. As a result, the spark discharge gap 33 can be maintained at a substantially fixed amount over a long period of time; accordingly, good ignition performance and durability can be maintained over a long period of time.

Additionally, according to the present embodiment, the relational expression $D/C \leq 0.7$ is satisfied. Therefore, the strength of joining the ground-electrode-side tip 32 to the ground electrode 27 can be remarkably improved, whereby separation resistance can be further improved. Also, since conduction of heat of the ground-electrode-side tip 32 to the ground electrode 27 is facilitated, erosion of the tip 32 can be effectively restrained, whereby durability can be further improved.

Also, according to the present embodiment, the ground-electrode-side tip 32 is joined to the ground electrode 27 through application of electricity to the tip 32 in a condition in which the proximal end portion 32E of the tip 32 is in a point or line contact with the ground electrode 27. Therefore, at the time of application of electricity, heat can be generated concentrically at a contact portion between the ground electrode 27 and the proximal end portion 32E of the ground-electrode-side tip 32. As a result, the fusion zone 35 can be reliably formed between the ground electrode 27 and the proximal end portion 32E of the ground-electrode-side tip 32, whereby the spark plug 1 having the above configuration can be readily yielded.

Next, in order to verify actions and effects to be yielded by the embodiment described above, spark plug samples which differed in E/F through adjustment of the greatest distance E (mm) and the largest amount of embedment F (mm) were manufactured. The samples were subjected to a first temperature cycle test on board engine. The first temperature cycle test on board engine is outlined below. The samples were mounted on a 6-cylinder SOHC engine having a displacement of 2,000 cc and were then repeatedly subjected, for 500 hours, to the following heat cycle: the engine was operated for one minute in a condition in which forward end portions of the samples had a temperature of 600° C. or 950° C.; subsequently, the forward end portions of the samples were held at 50° C. for 1.5 minutes. After the elapse of 500 hours, the samples were checked to see if the ground-electrode-side tip was detached from the ground electrode.

The detachment of the ground-electrode-side tip is more likely to occur in a condition in which a forward end portion of a sample has a temperature of 950° C. than in a condition in which a forward end portion of a sample has a temperature of 600° C. Thus, the samples which are free of detachment of the ground-electrode-side tip in a condition in which the forward end portions of the samples have a temperature of 600° C. can be said to have good separation resistance. Also, the samples which are free of detachment of the ground-electrode-side tip in a condition in which the forward end portions of the samples have a temperature of 950° C. can be said to have very good separation resistance.

Table 1 shows the results of the first temperature cycle test on board engine. In Table 1, "OK" indicates that the sample is free of detachment of the ground-electrode-side tip, and "NG" indicates that the sample suffers from detachment of the ground-electrode-side tip.

TABLE 1

| | | E/F | | | | | |
|---|---|---|---|---|---|---|---|
| | | 0.7 | 0.9 | 1.1 | 1.3 | 1.5 | 1.7 |
| Test temp. | 600° C. | NG | NG | OK | OK | OK | OK |
| | 950° C. | NG | NG | NG | NG | OK | OK |

E/F≥1.1 are free of detachment of the ground-electrode-side tip in a condition in which the forward end portions of the samples have a temperature of 600° C., indicating that the samples have good separation resistance. Conceivably, this is for the following reason: through employment of E/F≥1.1, the fusion zone sufficiently absorbed thermal stress generated between the ground electrode and the ground-electrode-side tip.

Particularly, the samples which satisfy the relational expression E/F≥1.5 are free of detachment of the ground-electrode-side tip even in a condition in which the forward end portions of the samples have a temperature of 950° C., indicating that the samples have very good separation resistance.

As is understood from the above test results, in order to reliably prevent the detachment of the ground-electrode-side tip from the ground electrode, satisfying the relational expression E/F≥1.1 is preferred.

Also, in view of further improvement of the effect of preventing the detachment of the ground-electrode-side tip, satisfying the relational expression E/F≥1.5 is more preferred.

Next, the samples which differed in A/B were manufactured and subjected to a second temperature cycle test on board engine. The second temperature cycle test on board engine is outlined below. The samples were mounted on a 6-cylinder SOHC engine having a displacement of 2,000 cc and were then repeatedly subjected, for 300 hours, to the following operation cycle: the engine was operated for one minute with full throttle opening (5,000 rpm); subsequently, the engine was idled for 1.5 minutes. After the elapse of 300 hours, the samples were checked to see if the ground-electrode-side tip was deformed in such a manner as to approach a forward end portion of the center electrode. The samples in which the ground-electrode-side tip is deformed in such a manner as to approach a forward end portion of the center electrode can be said to be able to effectively restrain an increase in the spark discharge gap stemming from spark discharge, etc., and have excellent ignition performance and durability.

Table 2 shows the results of the second temperature cycle test on board engine. In Table 2, "OK" indicates that the ground-electrode-side tip is deformed, and "NG" indicates that the ground-electrode-side tip is not deformed.

TABLE 2

| A/B | 0.4 | 0.5 | 0.6 | 0.7 | 0.8 |
|---|---|---|---|---|---|
| Evaluation | OK | OK | OK | NG | NG |

As shown in Table 2, in the samples which satisfy the relational expression A/B≤0.6, the ground-electrode-side tip is deformed in such a manner as to approach a forward end portion of the center electrode, indicating that an increase in the spark discharge gap can be restrained. Conceivably, this is for the following reason: thermal stress generated between the ground electrode and the second side of the ground electrode-side tip increased to a certain extent, whereby the generated thermal stress more reliably caused the ground-electrode-side tip to be deformed.

As is understood from the above test results, in view of improvement of ignition performance and durability through restraint of increase in the spark discharge gap, satisfying the relational expression A/B≤0.6 is preferred.

Next, the spark plug samples which differed in C/(B−A) were manufactured. The samples were subjected to a first durability test and then to a second durability test, for examining the durability of the samples.

The first durability test is outlined below. The samples were mounted on a 4-cylinder DOHC engine having a displacement of 2,000 cc and were then repeatedly subjected, for 300 hours, to the following operation cycle: the engine was idled (780 rpm) for five minutes, was operated at 5,500 rpm for 30 minutes, and then was operated at 3,000 rpm for 25 minutes.

The second durability test is outlined below. The samples were mounted on a 6-cylinder SOHC engine having a displacement of 2,000 cc and were then repeatedly subjected, for 300 hours, to the following operation cycle: the engine was operated for one minute with full throttle opening (5,000 rpm); subsequently, the engine was idled for 1.5 minutes.

Figure 5:
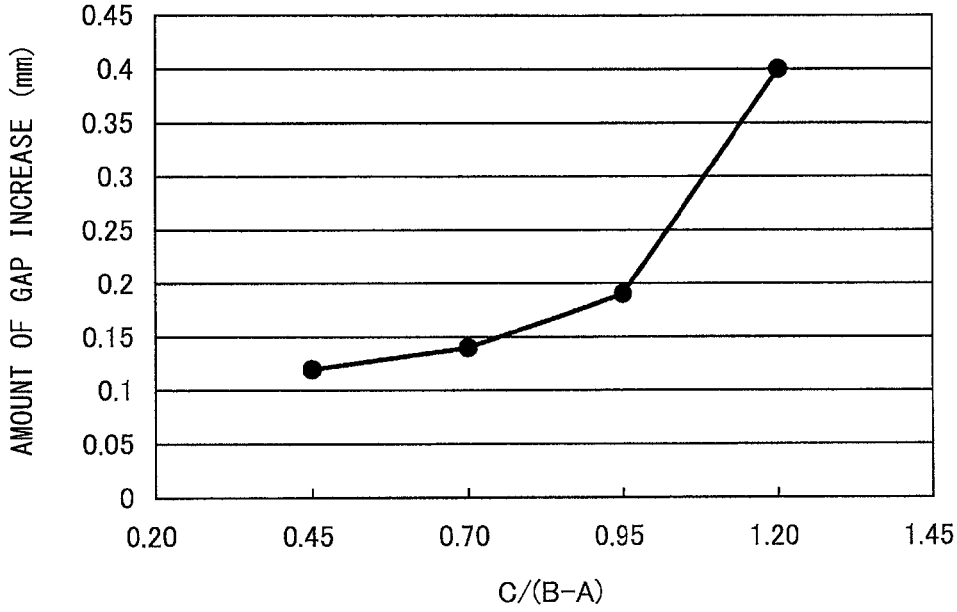
FIG. 5 is a graph showing the relation between C/(B−A) and the amount of gap increase.

After the two durability tests, the amount of increase in the spark discharge gap (amount of gap increase) was measured for evaluating the durability of the samples. FIG. 5 is a graph showing the relation between C/(B−A) and the amount of gap increase.

As shown in FIG. 5, the samples which satisfy the relational expression C/(B−A)≤0.95 exhibit an amount of increase in the spark discharge gap of 0.2 mm or less, indicating that an increase in the spark discharge gap can be quite effectively restrained. Conceivably, this is for the following reason: through satisfaction of C/(B−A)≤0.95, the amount of deformation of the ground-electrode-side tip (the amount of approach to a forward end portion of the center electrode) became substantially equivalent to the amount of increase in the spark discharge gap (the amount of increase in the case where the ground-electrode-side tip is not deformed); thus, the ground-electrode-side tip approached the center electrode by an amount substantially equal to the amount of increase in the spark discharge gap.

As is understood from the above test results, in view of maintaining good ignition performance and durability over a long period of time through more reliable restraint of an increase in the spark discharge gap, satisfying the relational expression C/(B−A)≤0.95 is preferred.

Next, spark plug samples which differed in D/C were manufactured. The samples were subjected to the first durability test mentioned above and were then measured for the amount ($mm^2$) of erosion of the ground-electrode-side tip. Also, the samples which differed in D/C were subjected to a desktop temperature cycle test. The desktop temperature cycle test is outlined below. The samples were subjected to 1,000 test cycles in the atmosphere, each test cycle consisting of heating by a predetermined burner for two minutes such that the ground electrode had a temperature of 1,050° C., and subsequent gradual cooling for one minute. After completion of 1,000 test cycles, the boundary portion between the ground-electrode-side tip and the fusion zone and between the ground electrode and the fusion zone were examined to measure the length of oxide scale formed at the boundary portion. The percentage of the length of oxide scale to the length of the boundary portion (percentage of oxide scale) was calculated.

Figure 6:
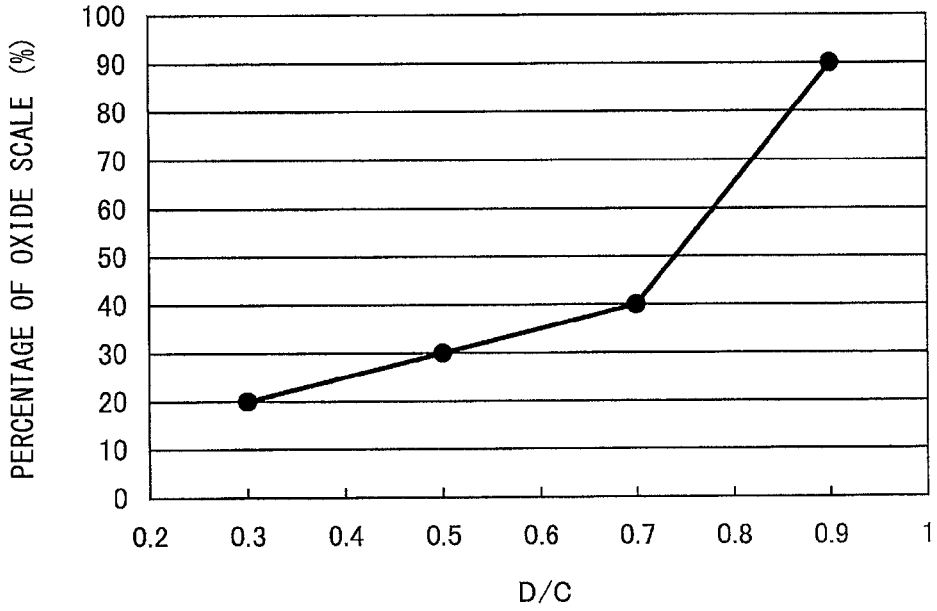
FIG. 6 is a graph showing the relation between D/C and the percentage of oxide scale.
Figure 7:
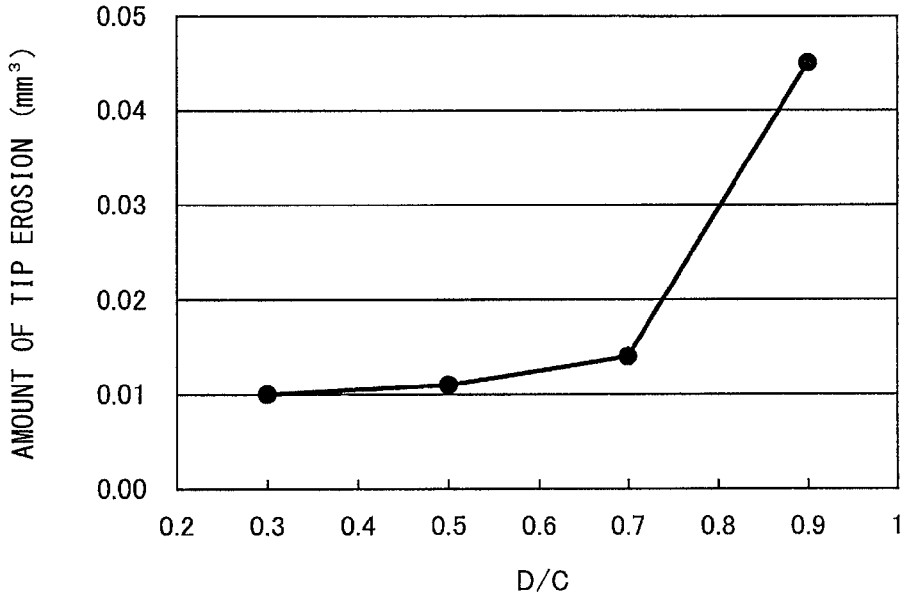
FIG. 7 is a graph showing the relation between D/C and the amount of tip erosion.

FIG. 6 shows the results of the desktop temperature cycle test, and FIG. 7 shows the results of the first durability test.

As shown in FIGS. 6 and 7, the samples which satisfy the relational expression D/C≤0.7 exhibit a very low percentage of oxide scale and a very small amount of erosion of the ground-electrode-side tip. Conceivably, this is for the following reason: through employment of a sufficiently large amount of embedment of the ground-electrode-side tip in the ground electrode, the strength of joining the ground-electrode-side tip to the ground electrode was remarkably improved, and conduction of heat of the ground-electrode-side tip to the ground electrode was facilitated.

As is understood from the results of the above two tests, in order to improve both of joining strength and durability, satisfying the relational expression D/C≤0.7 is preferred.

The present invention is not limited to the above-described embodiment, but may be embodied, for example, as follows. Of course, applications and modifications other than those exemplified below are also possible.

(a) In the above embodiment, the ground electrode 27 has the inclined surface 27N in order to bring the ground electrode 27 and the ground-electrode-side tip 32 into a point or line contact with each other when the ground-electrode-side tip 32 is to be joined to the ground electrode 27. However, a method for bringing the ground electrode 27 and the ground-electrode-side tip 32 into a point or line contact with each other is not limited thereto.

Figure 8:
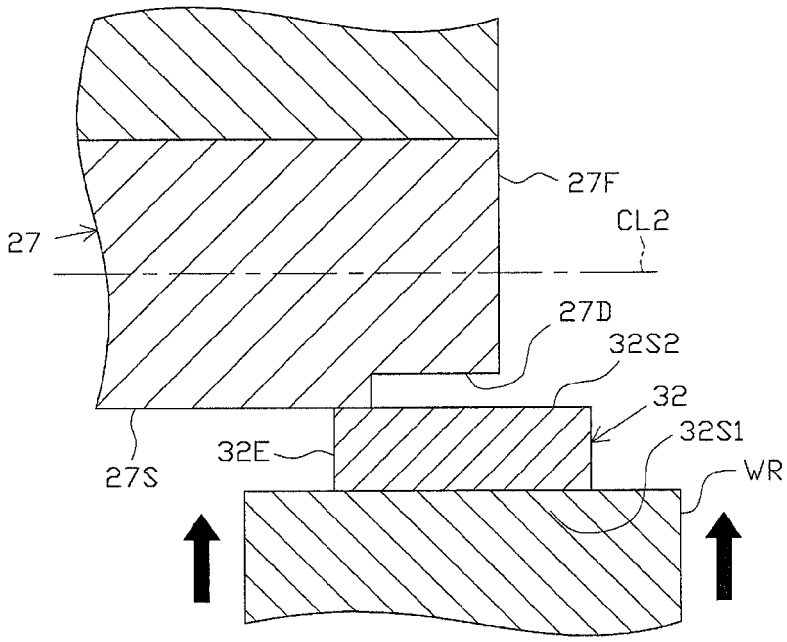
FIG. 8 is an enlarged sectional view showing another example of a step of joining the ground-electrode-side tip to the ground electrode.

For example, as shown in FIG. 8, a recess 27D may be provided at the distal end of the inner side surface 27S of the ground electrode 27 for bringing the ground electrode 27 and the ground-electrode-side tip 32 into a point or line contact with each other.

Figure 9:
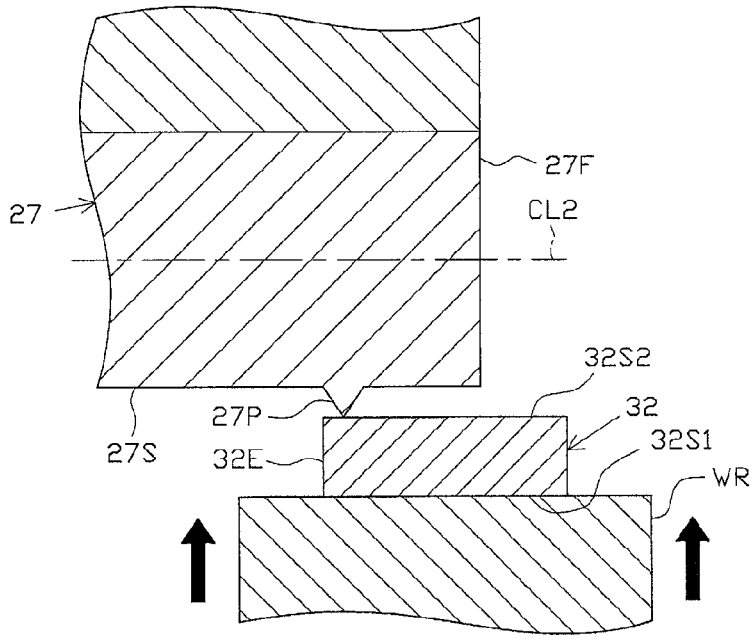
FIG. 9 is an enlarged sectional view showing a further example of a step of joining the ground-electrode-side tip to the ground electrode.

Also, for example, as shown in FIG. 9, a protrusion 27P may be provided on the inner side surface 27S for bringing the ground electrode 27 and the ground-electrode-side tip 32 into a point or line contact with each other through contact between the protrusion 27P and the ground-electrode-side tip 32.

Figure 10:
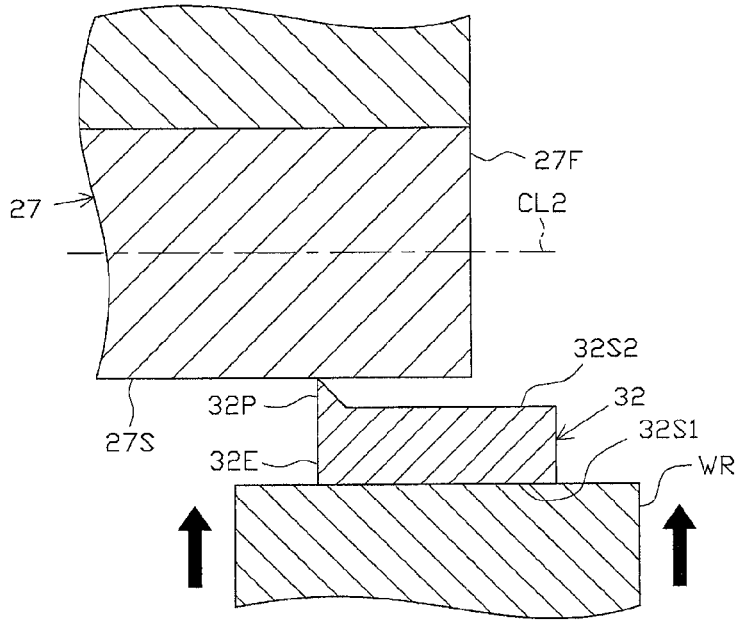
FIG. 10 is an enlarged sectional view showing a still further example of a step of joining the ground-electrode-side tip to the ground electrode.

Furthermore, for example, as shown in FIG. 10, a protrusion 32P may be provided on the second side 32S2 of the ground-electrode-side tip 32 for bringing the ground electrode 27 and the ground-electrode-side tip 32 into a point or line contact with each other through contact between the ground electrode 27 and the protrusion 32P.

Figure 11:
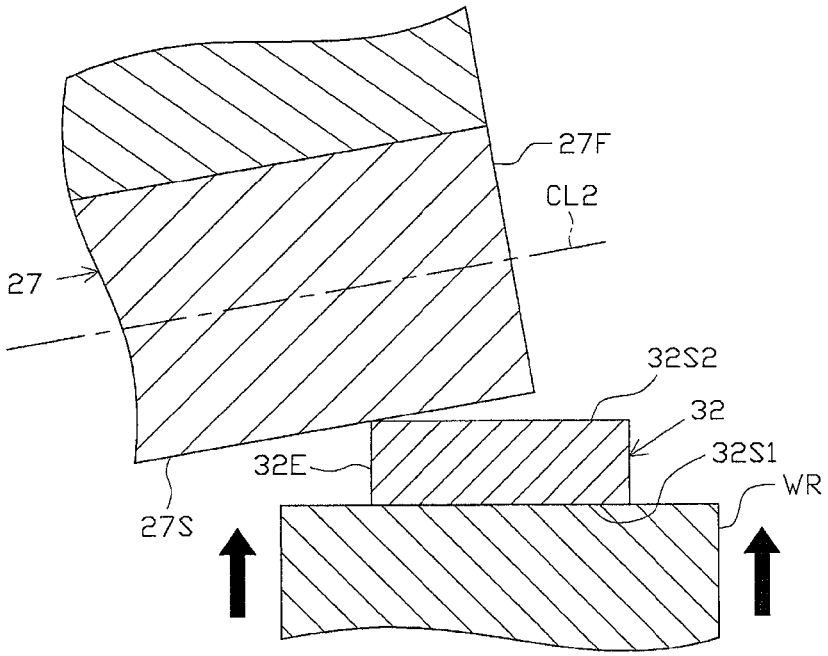
FIG. 11 is an enlarged sectional view showing yet another example of a step of joining the ground-electrode-side tip to the ground electrode.

Also, for example, as shown in FIG. 11, the inner side surface 27S may be inclined from the second side 32S2 for bringing the ground electrode 27 and the ground-electrode-side tip 32 into a point or line contact with each other.

Figure 12:
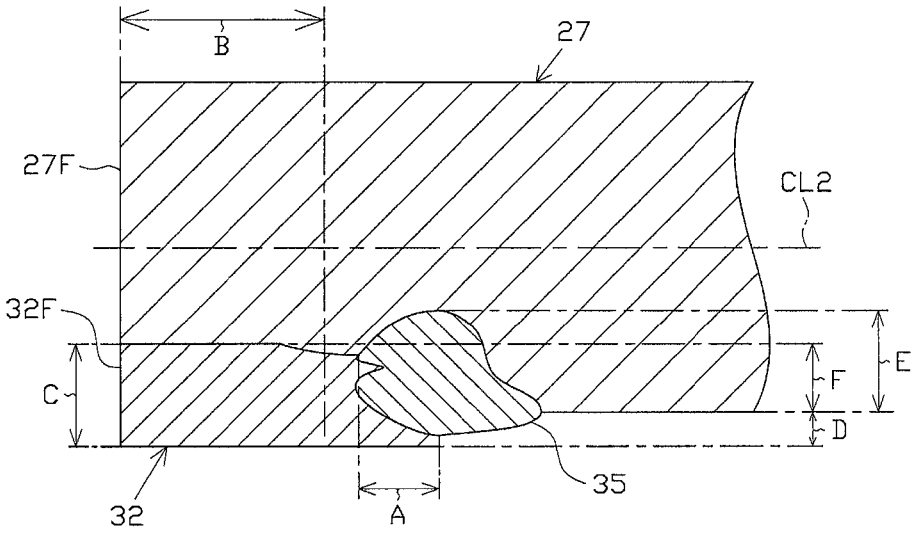
FIG. 12 is an enlarged sectional view showing the position of joining the ground-electrode-side tip to the ground electrode in another embodiment of the present invention.

(b) In the above embodiment, the distal end surface 32F of the ground-electrode-side tip 32 protrudes from the distal end surface 27F of the ground electrode 27. However, as shown in FIG. 12, the distal end surface 32F of the ground-electrode-side tip 32 may be disposed at the same position along the center axis CL2 as that of the distal end surface 27F of the ground electrode 27.

(c) In the above embodiment, the ground-electrode-side tip 32 is joined to the ground electrode 27 by resistance welding. However, the ground-electrode-side tip 32 may be joined to the ground electrode 27 by laser welding.

(d) In the above embodiment, the ground electrode 27 is joined to the forward end portion 26 of the metallic shell 3. However, the present invention is applicable to the case where a portion of a metallic shell (or a portion of an end metal piece welded beforehand to the metallic shell) is formed into a ground electrode by machining (refer to, for example, Japanese Patent Application Laid-Open (kokai) No. 2006-236906).

(e) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)].

DESCRIPTION OF REFERENCE NUMERALS

1: spark plug
2: insulator
3: metallic shell
4: axial hole
5: center electrode
27: ground electrode
27F: distal end surface (ground electrode)
27K: proximal end portion (ground electrode)
27S: inner side surface (ground electrode)
32: ground-electrode-side tip (tip)
32E: proximal side (ground-electrode-side tip)
32F: distal end surface (ground-electrode-side tip)
32S1: first side (ground-electrode-side tip)
32S2: second side (ground-electrode-side tip)
33: spark discharge gap (gap)
35: fusion zone
CL1: axial line
CL2: center axis (ground electrode)

The invention claimed is:

1. A spark plug comprising:

a tubular insulator having an axial hole extending therethrough in an axial direction;

a center electrode inserted into a forward end portion of the axial hole;

a tubular metallic shell provided around the insulator;

a rodlike ground electrode whose proximal end portion is fixed to a forward end portion of the metallic shell; and a tip that is joined to the ground electrode such that at least a portion of the tip along a thickness direction of the tip is embedded in an inner side surface of the ground electrode facing the center electrode, wherein a gap is formed between the tip and a forward end portion of the center electrode, the tip is joined to the ground electrode through a fusion zone which is provided between the ground electrode and a proximal side of the tip facing the proximal end portion of the ground electrode, the tip and the ground electrode being fused at the fusion zone, and on a section which contains a center axis of the ground electrode and is in parallel with the thickness direction of the tip, a relational expression $E/F \geq 1.1$ is satisfied, where E (mm) is a longest distance along the thickness direction from the inner side surface to a boundary between the fusion zone and the ground electrode, and F (mm) is a largest amount of embedment of the tip in the inner side surface along the thickness direction.

2. The spark plug according to claim 1, wherein a relational expression $E/F \geq 1.5$ is satisfied.

3. The spark plug according to claim 1, wherein the gap is formed between the forward end portion of the center electrode and a first side of the tip facing the center electrode and adjacent to a distal end surface of the tip located toward a distal end portion of the ground electrode;

the distal end surface of the tip is disposed at the same position along the center axis as that of a distal end of the ground electrode or protrudes from the distal end of the ground electrode;

the fusion zone is formed only on a side of the proximal side of the tip with respect to a center point of the tip along the center axis; and on the section, a relational expression $A/B \leq 0.6$ is satisfied, where A (mm) is a longest distance along the center axis from the proximal side of the tip to a boundary between the fusion zone and a second side of the tip located opposite the first side, and B (mm) is a longest distance along the center axis from the distal end surface of the ground electrode to the proximal side of the tip.

4. The spark plug according to claim 3, wherein a relational expression $C/(B-A) \leq 0.95$ is satisfied, where C (mm) is a largest thickness of the tip.

5. The spark plug according to claim 1, wherein a relational expression $D/C \leq 0.7$ is satisfied, where C (mm) is a largest thickness of the tip, and D (mm) is an amount of protrusion of the tip from the inner side surface along the thickness direction.

6. A method of manufacturing a spark plug according to claim 1, comprising a step of joining the tip to the ground electrode through application electricity to the tip in a condition in which the proximal side of the tip is in a point or line contact with the ground electrode.

7. The spark plug according to claim 1, wherein the gap is formed between the forward end portion of the center electrode and a first side of the tip facing the center electrode and adjacent to a distal end surface of the tip located toward a distal end portion of the ground electrode;

the distal end surface of the tip is disposed at the same position along the center axis as that of a distal end of the ground electrode or protrudes from the distal end of the ground electrode;

the fusion zone is formed only on a side of the proximal side of the tip with respect to a center point of the tip along the center axis; and on the section, a relational expression $A/B \leq 0.6$ is satisfied, where A (mm) is a longest distance along the center axis from the proximal side of the tip to a boundary between the fusion zone and a second side of the tip located opposite the first side, and B (mm) is a longest distance along the center axis from the distal end surface of the ground electrode to the proximal end portion of the tip.

8. The spark plug according to claim 2, wherein a relational expression $D/C \leq 0.7$ is satisfied, where C (mm) is a largest thickness of the tip, and D (mm) is an amount of protrusion of the tip from the inner side surface along the thickness direction.

9. A spark plug according to claim 3, wherein a relational expression $D/C \leq 0.7$ is satisfied, where C (mm) is a largest thickness of the tip, and D (mm) is an amount of protrusion of the tip from the inner side surface along the thickness direction.

10. The spark plug according to claim 4, wherein a relational expression $D/C \leq 0.7$ is satisfied, where C (mm) is a largest thickness of the tip, and D (mm) is an amount of protrusion of the tip from the inner side surface along the thickness direction.

11. The method of manufacturing a spark plug according to claim 2, comprising a step of joining the tip to the ground electrode through application electricity to the tip in a condition in which the proximal side of the tip is in a point or line contact with the ground electrode.

12. The method of manufacturing a spark plug according to claim 3, comprising a step of joining the tip to the ground electrode through application electricity to the tip in a condition in which the proximal side of the tip is in a point or line contact with the ground electrode.

13. The method of manufacturing a spark plug according to claim 4, comprising a step of joining the tip to the ground electrode through application electricity to the tip in a condition in which the proximal side of the tip is in a point or line contact with the ground electrode.

14. The method of manufacturing a spark plug according to claim 5, comprising a step of joining the tip to the ground electrode through application electricity to the tip in a condition in which the proximal side of the tip is in a point or line contact with the ground electrode.

* * * * *